US011460244B2

(12) United States Patent
Hu et al.

(10) Patent No.: US 11,460,244 B2
(45) Date of Patent: Oct. 4, 2022

(54) SYSTEM AND METHOD FOR PRODUCING LIQUEFIED NATURAL GAS

(71) Applicant: GENERAL ELECTRIC COMPANY, Schenectady, NY (US)

(72) Inventors: Lishun Hu, Shanghai (CN); Jie Zhang, Shanghai (CN); Harish Radhakrishna Acharya, Niskayuna, NY (US); Junli Xue, Shanghai (CN); Jing Lv, Shanghai (CN)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 721 days.

(21) Appl. No.: 16/308,438

(22) PCT Filed: May 30, 2017

(86) PCT No.: PCT/US2017/034959
§ 371 (c)(1),
(2) Date: Dec. 7, 2018

(87) PCT Pub. No.: WO2018/004922
PCT Pub. Date: Jan. 4, 2018

(65) Prior Publication Data

US 2019/0137170 A1 May 9, 2019

(30) Foreign Application Priority Data

Jun. 30, 2016 (CN) ..... 201610504017.X

(51) Int. Cl.
*F25J 1/00* (2006.01)
*F25J 1/02* (2006.01)

(52) U.S. Cl.
CPC ..... *F25J 1/0022* (2013.01); *F25J 1/005* (2013.01); *F25J 1/0052* (2013.01); *F25J 1/0057* (2013.01);
(Continued)

(58) Field of Classification Search
CPC ..... F25J 3/08; F25J 2205/10; F25J 1/0012; F25J 1/005; F25J 1/0022; F25J 2210/60;
(Continued)

(56) References Cited

U.S. PATENT DOCUMENTS 1,199,701 A 9/1916 Hildebrandt
3,593,535 A * 7/1971 Gaumer, Jr. ..... F25J 1/025 62/502

(Continued)

FOREIGN PATENT DOCUMENTS

CN 101387469 A 3/2009
CN 100552322 C 10/2009

(Continued)

OTHER PUBLICATIONS

A PCT Search Report and Written Opinion issued in connection with corresponding Application No. PCT/US2017/034959 dated Aug. 14, 2017.

(Continued)

*Primary Examiner* — Brian M King
*Assistant Examiner* — Erik Mendoza-Wilkenfel
(74) *Attorney, Agent, or Firm* — Baker Hughes Patent Org; Marc Vivenzio

(57) ABSTRACT

A system and a method for producing liquefied natural gas are provided. The system includes a refrigeration loop system for providing a cold stream of refrigerant, a supersonic chiller for receiving and chilling a first gaseous natural gas stream to produce a liquefied natural gas liquid and separating the liquefied natural gas liquid from the first (Continued)

gaseous natural gas stream to obtain a second gaseous natural gas stream, and a cold box for receiving the cold stream of refrigerant and the second gaseous natural gas stream and cooling the second gaseous natural gas stream to obtain a liquefied natural gas by heat exchanging between the second gaseous natural gas stream and the cold stream of refrigerant.

14 Claims, 10 Drawing Sheets

(52) U.S. Cl.
CPC ..... *F25J 1/0072* (2013.01); *F25J 1/0082* (2013.01); *F25J 1/0204* (2013.01); *F25J 1/0212* (2013.01); *F25J 2220/64* (2013.01); *F25J 2230/30* (2013.01); *F25J 2240/40* (2013.01); *F25J 2270/16* (2013.01)

(58) Field of Classification Search
CPC .. F25J 2270/12; F25J 2270/14; F25J 2270/16; F25J 2270/18; F25J 2270/60; F25J 2270/66; F25J 2215/60; F25J 2230/30; F25J 2200/02; F25J 2230/02; F25J 1/00; F25J 1/0025; F25J 1/0047; F25B 9/06
See application file for complete search history.

(56) References Cited

U.S. PATENT DOCUMENTS

| | | | | |
|---|---|---|---|---|
| 3,791,157 | A * | 2/1974 | Tracy | F25J 1/0022 62/927 |
| 4,169,361 | A | 10/1979 | Baldus | |
| 4,901,533 | A * | 2/1990 | Fan | F25J 1/0022 62/614 |
| 4,911,741 | A * | 3/1990 | Davis | F25J 1/0292 62/611 |
| 4,948,404 | A * | 8/1990 | Delong | F25J 3/0257 62/619 |
| 6,094,937 | A | 8/2000 | Pentti et al. | |
| 7,357,825 | B2 | 4/2008 | Betting et al. | |
| 2003/0177785 | A1* | 9/2003 | Kimble | F25J 1/0022 62/613 |
| 2009/0031756 | A1* | 2/2009 | Betting | F25J 3/0238 62/620 |
| 2011/0296986 | A1* | 12/2011 | Buhrman | C01B 23/0089 95/34 |
| 2012/0090467 | A1 | 4/2012 | Betting et al. | |
| 2013/0019612 | A1 | 1/2013 | Favilli et al. | |
| 2013/0152627 | A1 | 6/2013 | Lourenco et al. | |
| 2013/0219955 | A1 | 8/2013 | Yoo et al. | |
| 2014/0137599 | A1 | 5/2014 | Oelfke et al. | |
| 2014/0283549 | A1 | 9/2014 | Madison | |
| 2015/0204603 | A1 | 7/2015 | Sheng et al. | |
| 2017/0038139 | A1* | 2/2017 | Turney | F25J 1/0072 |

FOREIGN PATENT DOCUMENTS

| | | | |
|---|---|---|---|
| CN | 201377960 | Y | 1/2010 |
| CN | 100589883 | C | 2/2010 |
| CN | 101504244 | B | 2/2011 |
| CN | 202039046 | U | 11/2011 |
| CN | 202083174 | U | 12/2011 |
| CN | 102353233 | A | 2/2012 |
| CN | 202254637 | U | 5/2012 |
| CN | 102538391 | A | 7/2012 |
| CN | 102564059 | A | 7/2012 |
| CN | 102654347 | A | 9/2012 |
| CN | 102661653 | A | 9/2012 |
| CN | 101508925 | B | 10/2012 |
| CN | 102863995 | A | 1/2013 |
| CN | 202655135 | U | 1/2013 |
| CN | 101948706 | B | 2/2013 |
| CN | 102927791 | A | 2/2013 |
| CN | 102954667 | A | 3/2013 |
| CN | 202813975 | U | 3/2013 |
| CN | 102489081 | B | 8/2013 |
| CN | 102268309 | B | 10/2013 |
| CN | 102628634 | B | 10/2013 |
| CN | 102994184 | B | 10/2013 |
| CN | 103542692 | A | 1/2014 |
| CN | 103968242 | A | 8/2014 |
| CN | 203868680 | U | 10/2014 |
| CN | 203980789 | U | 12/2014 |
| CN | 102654348 | B | 1/2015 |
| CN | 204251575 | U | 4/2015 |
| CN | 204550489 | U | 8/2015 |
| CN | 104913554 | A | 9/2015 |
| CN | 204678750 | U | 9/2015 |
| CN | 105202866 | A | 12/2015 |
| CN | 204880968 | U | 12/2015 |
| JP | 0448184 | A | 2/1992 |
| KR | 20150001597 | A | 1/2015 |
| KR | 101511211 | B1 | 4/2015 |
| KR | 1519541 | B1 | 5/2015 |
| WO | 2012113347 | A1 | 8/2012 |

OTHER PUBLICATIONS

P. Schinkelshoek et al., "Supersonic Gas Conditioning—Low Pressure Drop TWISTER for NGL Recovery", Offshore Technology Conference, pp. 4, May 1-4, 2006, Houston, Texas, USA.

Xie-Qin et al., "Supersonic Separator:New-type and High-effective Installations Used for Dehydration and De-hydrocarbon of Natural Gas", Natural Gas Technology, Issue: 5, 2007.

* cited by examiner

SYSTEM AND METHOD FOR PRODUCING LIQUEFIED NATURAL GAS

BACKGROUND OF THE INVENTION

Embodiments of the invention relate to systems and methods for producing liquefied natural gas (LNG).

Natural gas is a fossil fuel used as a source of energy for heating, cooking, and electricity generation. It is also used as fuel for vehicles and as a chemical feedstock in the manufacture of plastics and other commercially important organic chemicals. The volume of natural gas is reduced after liquefied. The volume of LNG is about 1/625 of the volume of the gaseous natural gas, so the LNG is easily stored and transported. Various LNG producing systems are provided, and a cold box is usually included in these LNG producing systems to liquefy natural gas.

However, these LNG producing systems are still not good enough and it is desirable to provide a new system and a method of producing liquefied natural gas.

BRIEF DESCRIPTION

In accordance with one embodiment disclosed herein, a system for producing liquefied natural gas is provided. The system includes a refrigeration loop system for providing a cold stream of refrigerant; a supersonic chiller for receiving and chilling a first gaseous natural gas stream to produce a liquefied natural gas liquid, and separating the liquefied natural gas liquid from the first gaseous natural gas stream to obtain a second gaseous natural gas stream; and a cold box for receiving the cold stream of refrigerant and the second gaseous natural gas stream, and cooling the second gaseous natural gas stream to obtain a liquefied natural gas by heat exchanging between the second gaseous natural gas stream and the cold stream of refrigerant.

In accordance with another embodiment disclosed herein, a method for producing liquefied natural gas is provided. The method includes providing, via a refrigeration loop system, a cold stream of refrigerant; receiving and chilling, via a supersonic chiller, a first gaseous natural gas stream to produce a liquefied natural gas liquid, and separating the liquefied natural gas liquid from the first gaseous natural gas stream to obtain a second natural gas stream; and receiving, via a cold box, the cold stream of refrigerant and the second natural gas stream, and cooling the second gaseous natural gas stream to obtain a liquefied natural gas by heat exchanging between the second gaseous natural gas stream and the cold stream of refrigerant.

BRIEF DESCRIPTION OF THE DRAWINGS

These and other features and aspects of the present disclosure will become better understood when the following detailed description is read with reference to the accompanying drawings in which like characters represent like parts throughout the drawings, wherein.

DETAILED DESCRIPTION

Figure 1:
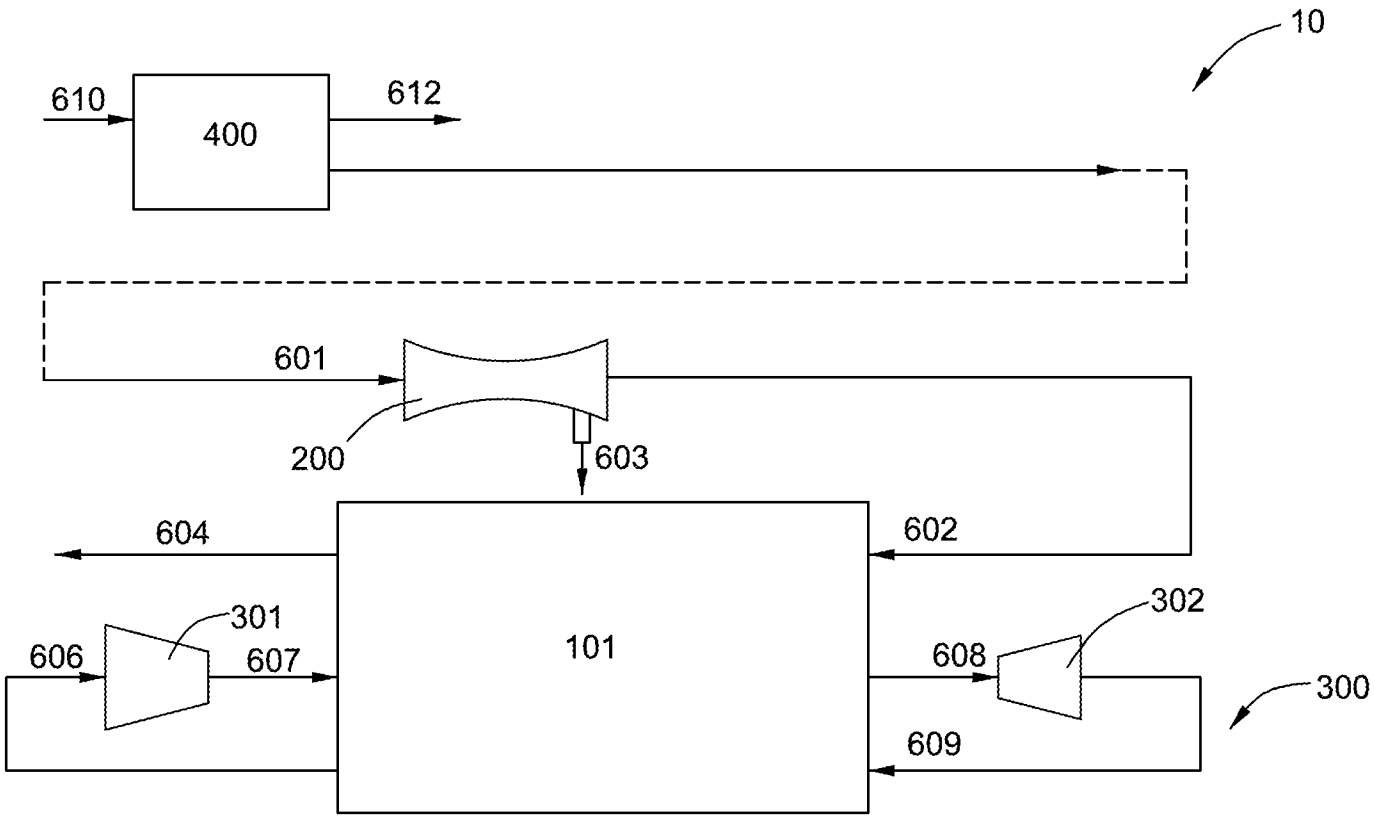
FIG. 1 is a schematic diagram of a system for producing LNG in accordance with an embodiment.

Unless defined otherwise, technical and scientific terms used herein have the same meaning as is commonly understood by one of ordinary skill in the art to which this disclosure belongs. The terms "a" and "an" do not denote a limitation of quantity, but rather denote the presence of at least one of the referenced items. The use of "including," "comprising" or "having" and variations thereof herein are meant to encompass the items listed thereafter and equivalents thereof as well as additional items. The terms "first", "second" and the like in the description and the claims do not mean any sequential order, number or importance, but are only used for distinguishing different components.

Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

The term "gas" is used interchangeably with "vapor," and means a substance or mixture of substances in the gaseous state as distinguished from the liquid or solid state. Likewise, the term "liquid" means a substance or mixture of substances in the liquid state as distinguished from the gas or solid state.

The term "natural gas" refers to a multi-component substance comprising a mixture of hydrocarbons. The composition and pressure of natural gas can vary significantly. A typical natural gas stream comprises methane (C1) as a significant component. Raw natural gas may be obtained from a crude oil well (associated gas) or from a subterranean gas-bearing formation (non-associated gas). Raw natural gas may typically comprise methane (C1), and may also typically comprise ethane (C2), higher molecular weight hydrocarbons, one or more acid gases (such as carbon dioxide, hydrogen sulfide, carbonyl sulfide, carbon disulfide, and mercaptans), and minor amounts of contaminants (such as water, mercury, helium, nitrogen, iron sulfide, wax, and crude oil). The composition of the raw natural gas can vary.

"Acid gases" are contaminants that are often encountered in natural gas streams. Typically, these gases include carbon dioxide (CO2) and hydrogen sulfide (H2S), although any number of other contaminants may also form acids. Acid gases are commonly removed by contacting the gas stream with an absorbent, such as an amine, which may react with the acid gas. When the absorbent becomes acid-gas "rich," a desorption step can be used to separate the acid gases from the absorbent. The "lean" absorbent is then typically recycled for further absorption.

"Liquefied natural gas (LNG)" is a cryogenic liquid form of natural gas generally known to include a high percentage of methane, but may also include trace amounts of other elements and/or compounds including, but not limited to, ethane, propane, butane, carbon dioxide, nitrogen, helium, hydrogen sulfide, or combinations thereof.

"Natural gas liquid (NGL)" is a cryogenic liquid form of natural gas generally known to include a high percentage of "Heavy hydrocarbons", but may also include trace amounts of other elements and/or compounds including, but not limited to, methane, ethane, carbon dioxide, nitrogen, helium, hydrogen sulfide, or combinations thereof.

"Gaseous natural gas stream" is a stream mainly comprising gaseous natural gas, but may also comprise trace amounts of liquids.

"Heavy hydrocarbons" are the hydrocarbons having carbon number higher than three (including three), which may be referred as to "higher carbon number hydrocarbons" or abbreviated as "C3+".

FIG. 1 illustrates a schematic diagram of a system 10 for producing LNG in accordance with an embodiment. The system 10 comprises a cold box 101, a supersonic chiller 200 and a refrigeration loop system 300.

The cold box 101 comprises one or a plurality of heat exchangers. "Heat exchanger" refers to any column, tower, unit or other arrangement adapted to allow the passage of two or more streams and to affect direct or indirect heat exchange between the two or more streams. Examples include a tube-in-shell heat exchanger, a cryogenic spool-wound heat exchanger, or a brazed aluminum-plate fin heat exchanger, among others.

The supersonic chiller (or referred as to "supersonic swirling separator") 200 receives and chills a first gaseous natural gas stream 601 to produce a liquefied natural gas liquid (hereinafter referred to as "NGL") 603, and separates the liquefied NGL 603 from the first gaseous natural gas stream 601 to obtain a second gaseous natural gas stream 602.

In some embodiments, the supersonic chiller 200 is a device comprising a convergent-divergent Laval Nozzle, in which the potential energy (pressure and temperature) of the first gaseous natural gas stream 601 transforms into kinetic energy (velocity) of the first gaseous natural gas stream 601. The velocity of the first gaseous natural gas stream 601 reaches supersonic values. Thanks to gas acceleration, sufficient temperature and pressure drops are obtained, thereby target component(s), e.g. heavy hydrocarbons, in the first gaseous natural gas stream 601 is liquefied to form the liquefied NGL 603. The liquefied NGL 603 is separated from the first gaseous natural gas stream 601 through highly swirling. Then the high velocity is slowed down and the pressure is recovered to some of the initial pressure, thereby the second gaseous natural gas stream 602 is obtained.

In some embodiments, the pressure of the first gaseous natural gas stream 601 ranges from about 3 MPa to about 8 MPa. In some embodiments, the temperature of the first gaseous natural gas stream 601 is within a normal temperature, for example, about within 20-45° C., and the temperature of the second gaseous natural gas stream 602 ranges from about 10° C. to about 40° C. In some embodiments, the temperature of the first gaseous natural gas stream 601 ranges from about 0° C. to about −10° C., and the temperature of the second gaseous natural gas stream 602 ranges from about −25° C. to about −30° C. In some embodiments, the temperature of the liquefied NGL 603 ranges from about −45° C. to about −75° C.

A refrigerant stream flows in the refrigeration loop system 300. The refrigeration loop system 300 provides a cold stream 609 of refrigerant to the cold box 101 for refrigeration. In some embodiments, the refrigerant comprises but is not limited to nitrogen, methane, a mixed refrigerant or any combination thereof. In some embodiments, the mixed refrigerant comprises nitrogen, methane, ethane, ethylene, propane; in some embodiments, the mixture refrigerant may further comprise at least one of butane, pentane and hexane.

In some embodiments, the refrigeration loop system 300 comprises a compressing module 301 and an expanding module 302.

The compressing module 301 refers to a module for compressing a refrigerant stream, thereby increasing its pressure. The compressing module 301 receives and compresses a heat exchanged refrigerant stream 606 from the cold box 101 to obtain a hot stream 607 of refrigerant, and provides the hot stream 607 of refrigerant to the cold box 101. The cold box 101 cools the hot stream 607 of refrigerant to obtain a cooled refrigerant stream 608.

In some embodiments, the temperature of the heat exchanged refrigerant stream 606 is within a normal temperature, for example, about within 20-45° C., and the pressure of the heat exchanged refrigerant stream 606 ranges from about 0.2 MPa to about 1.5 MPa. In some embodiments, the temperature of the hot stream 607 of refrigerant ranges from about 30° C. to about 50° C., and the pressure of the hot stream 607 of refrigerant ranges from about 2 MPa to about 6 MPa. In some embodiments, the temperature of the cooled refrigerant stream 608 ranges from about −80° C. to about −162° C., and the pressure of the cooled refrigerant stream 608 ranges from about 2 MPa to about 6 MPa.

In some embodiments, the compressing module 301 may comprise a plurality of compressors to perform a multistage compression. "Compressor" refers to a device for compressing gases, and includes but is not limited to pumps, compressor turbines, reciprocating compressors, piston compressors, rotary vane or screw compressors, and devices and combinations capable of compressing gases.

The expanding module 302 refers to a module for expanding the refrigerant stream, thereby reducing its pressure and temperature. The expanding module 302 receives and expands the cooled refrigerant stream 608 to obtain a cold stream 609 of refrigerant, and provides the cold stream 609 of refrigerant to the cold box 101. The cold box 101 obtains the heat exchanged refrigerant stream 606 by heat exchanging the cold stream 609 of refrigerant with the second gaseous natural gas stream 602 and the hot stream of refrigerant 607. The heat exchanged refrigerant stream 606 is provided to the compressing module 301, thus a loop of flow of the refrigerant is formed.

In some embodiments, the temperature of the cold stream 609 of refrigerant ranges from about −160° C. to about −170° C., and the pressure of the cold stream 609 of refrigerant ranges from about 0.2 MPa to about 1.5 MPa.

In some embodiments, the expanding module 302 comprises a Joule-Thomson (J-T) valve, which utilizes the Joule-Thomson principle that expansion of gas will result in an associated cooling of the gas. In various embodiments described herein, a J-T valve may be substituted by other expander, such as turbo-expanders, and the like.

Figure 7:
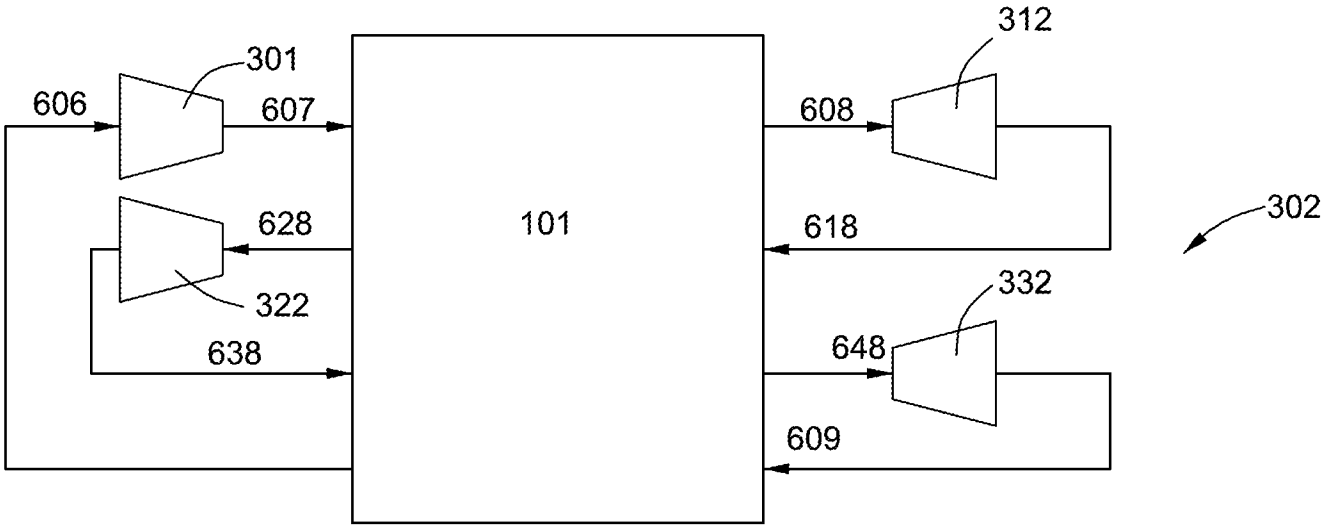
FIG. 7 is a schematic diagram of a refrigeration loop system and a cold box in accordance with an embodiment of the present invention

In some embodiments, the expanding module 302 comprises a plurality of expanders, each of which expands a cooled refrigerant stream from the cold box 101 and provides an expanded refrigerant stream to the cold box 101. For example, as shown in FIG. 7, the expanding module 302 comprises a first expander 312, a second expander 322, and a third expander 332. The first expander 312 receives and expands the cooled refrigerant stream 608 from the cold box 101 to obtain an expanded refrigerant stream 618, and provides it to the cold box 101. The cold box 101 cools the expanded refrigerant stream 618 to obtain a cooled refrigerant stream 628. The second expander 322 receives and expands the cooled refrigerant stream 628 from the cold box 101 to obtain an expanded refrigerant stream 638, and provides it to the cold box 101. The cold box 101 cools the expanded refrigerant stream 638 to obtain a cooled refrigerant stream 648. The third expander 332 receives and expands the cooled refrigerant stream 648 from the cold box 101 to obtain the cold stream 609 of refrigerant (i.e., an expanded refrigerant stream obtained by expanding the cooled refrigerant stream 648), and provides it to the cold box 101.

Please refer to FIG. 1. The cold box 101 receives the cold stream 609 of refrigerant and the second gaseous natural gas stream 602, and cools the second gaseous natural gas stream 602 to obtain a liquefied natural gas (hereinafter referred to as "LNG") 604 by heat exchanging between the second gaseous natural gas stream 602 and the cold stream 609 of refrigerant.

In some embodiments, the system 10 further comprises a pretreatment module 400. The pretreatment module 400 receives a raw natural gas stream 610, separates an impurity 612 from the raw natural gas stream to obtain the first gaseous natural gas stream 601, and provides the first nauseous natural gas stream 601 to the supersonic chiller 200.

The impurity 612 may comprise but be not limited to acid gases (such as carbon dioxide, hydrogen sulfide, carbonyl sulfide, carbon disulfide, and mercaptans), and trace amounts of contaminants (such as water, mercury, helium, nitrogen, iron sulfide, wax, and crude oil).

In some embodiments, the pretreatment module 400 may comprise a plurality of units (not shown) for removing the acid gases and the minor amounts of contaminants respectively. In some embodiments, the acid gases may be removed by contacting the raw natural gas stream 610 with an absorbent, and the trace amounts of contaminants may be removed by molecular sieves.

Various changes of the system 10 may be made. Some embodiments are introduced hereinafter to describe some of the various changes of the system 10.

Figure 2:
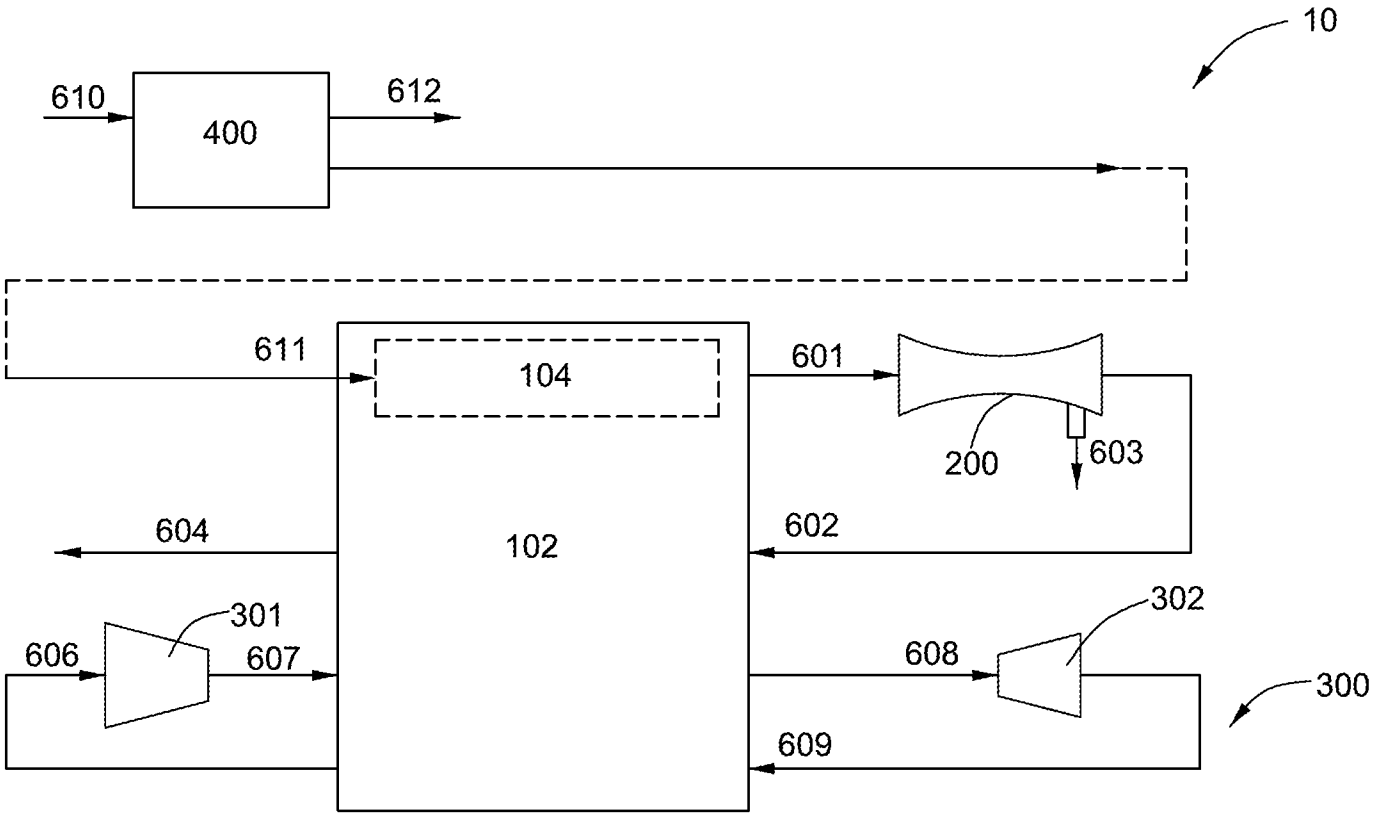
FIG. 2 is a schematic diagram of a system for producing LNG in accordance with another embodiment.

In the embodiment according to FIG. 2, the cold box 101 shown in FIG. 1 is replaced with a cold box 102 comprising a pre-cooling module 104. In some embodiments, the pre-cooling module 104 may be a group of heat exchangers in the cold box 102.

The pretreatment module 400 in FIG. 2 receives the raw natural gas stream 610, separates the impurity 612 from the raw natural gas stream 610 to obtain a third gaseous natural gas stream 611 and provides the third gaseous natural gas stream 611 to the pre-cooling module 104. In some embodiments, the pressure of the third gaseous natural gas stream 611 ranges from about 3 Mpa to about 8 Mpa. In some embodiments, the temperature of the third gaseous natural gas stream 611 is within a normal temperature, for example, about within 20-45° C.

The pre-cooling module 104 cools the third gaseous natural gas stream 611 to obtain the first gaseous natural gas stream 601, and provides the first gaseous natural gas stream 601 to the supersonic chiller 200. In the embodiment according to FIG. 2, the temperature of the first gaseous natural gas stream 601 may range from about 0° C. to about −10° C.

Figure 3:
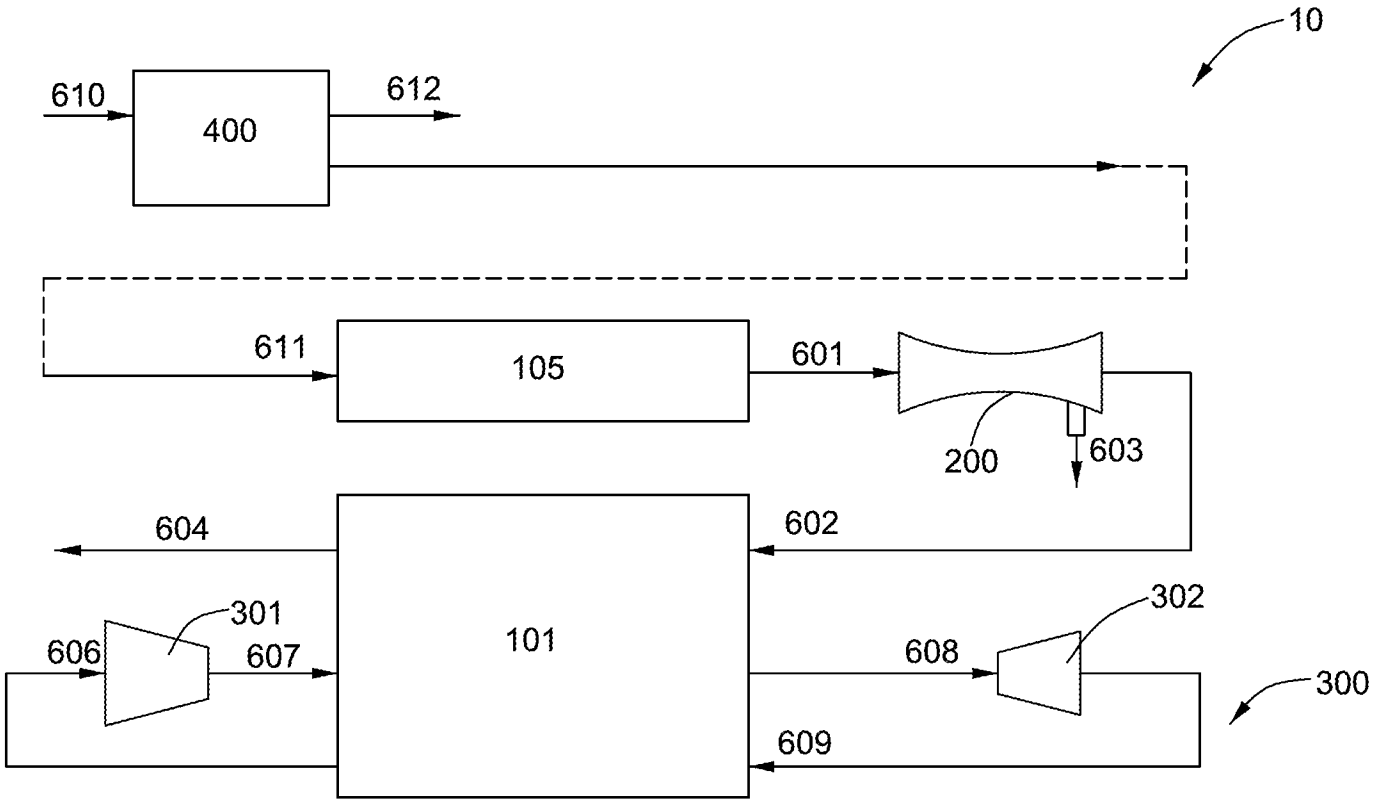
FIG. 3 is a schematic diagram of a system for producing LNG in accordance with a further embodiment.

In the embodiment according to FIG. 3, the system 10 further comprises a pre-cooling module 105 located between the pretreatment module 400 and the supersonic chiller 200. The pre-cooling module 105 may be another cold box separated from the cold box 101. The pre-cooling module 105 cools the third gaseous natural gas stream 611 from the pretreatment module 400 to obtain the first gaseous natural gas stream 601, and provides the first gaseous natural gas stream 601 to the supersonic chiller 200. In the embodiment according to FIG. 3, the temperature of the first gaseous natural gas stream 601 may range from about 0° C. to about −10° C.

Figure 4:
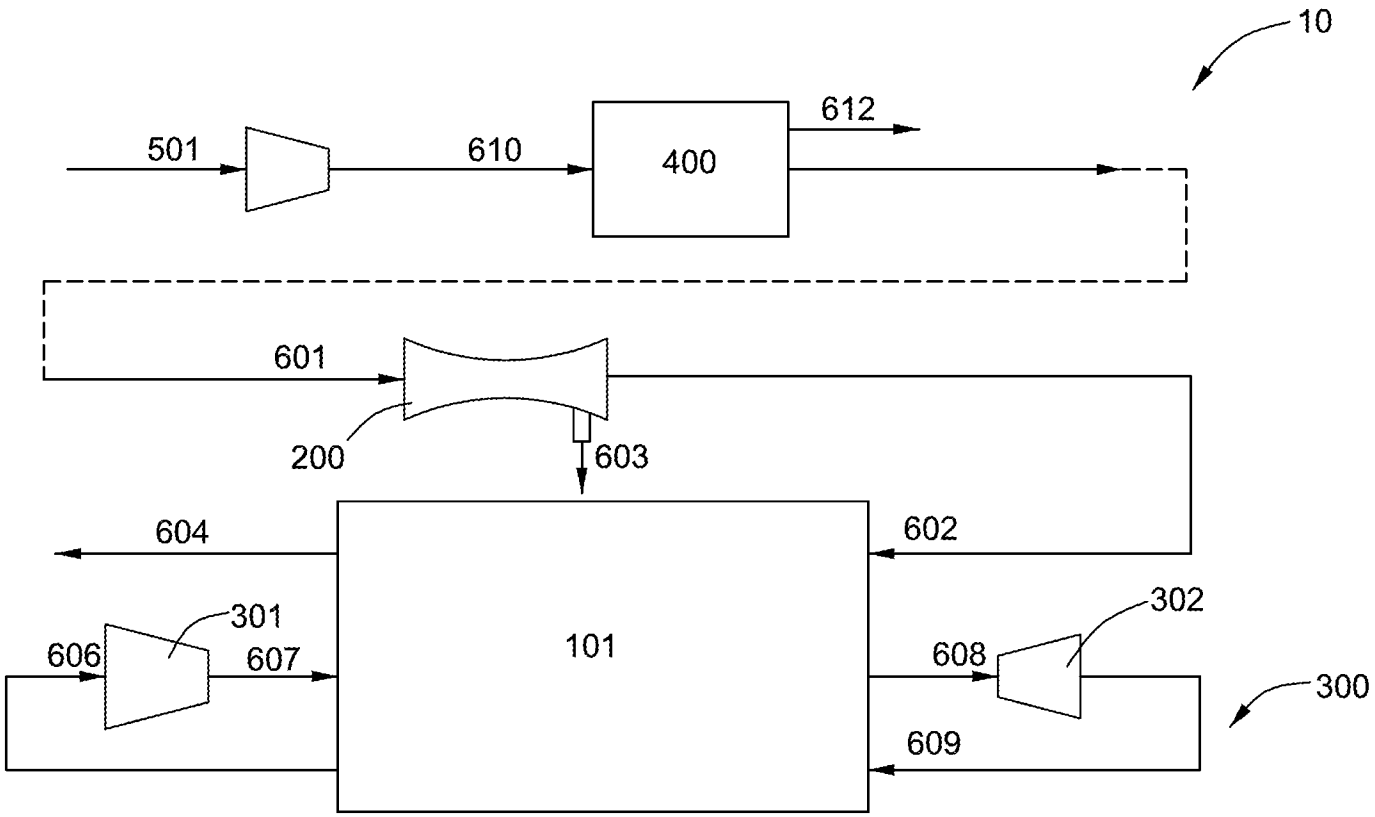
FIG. 4 is a schematic diagram of a system for producing LNG in accordance with a further embodiment.
Figure 5:
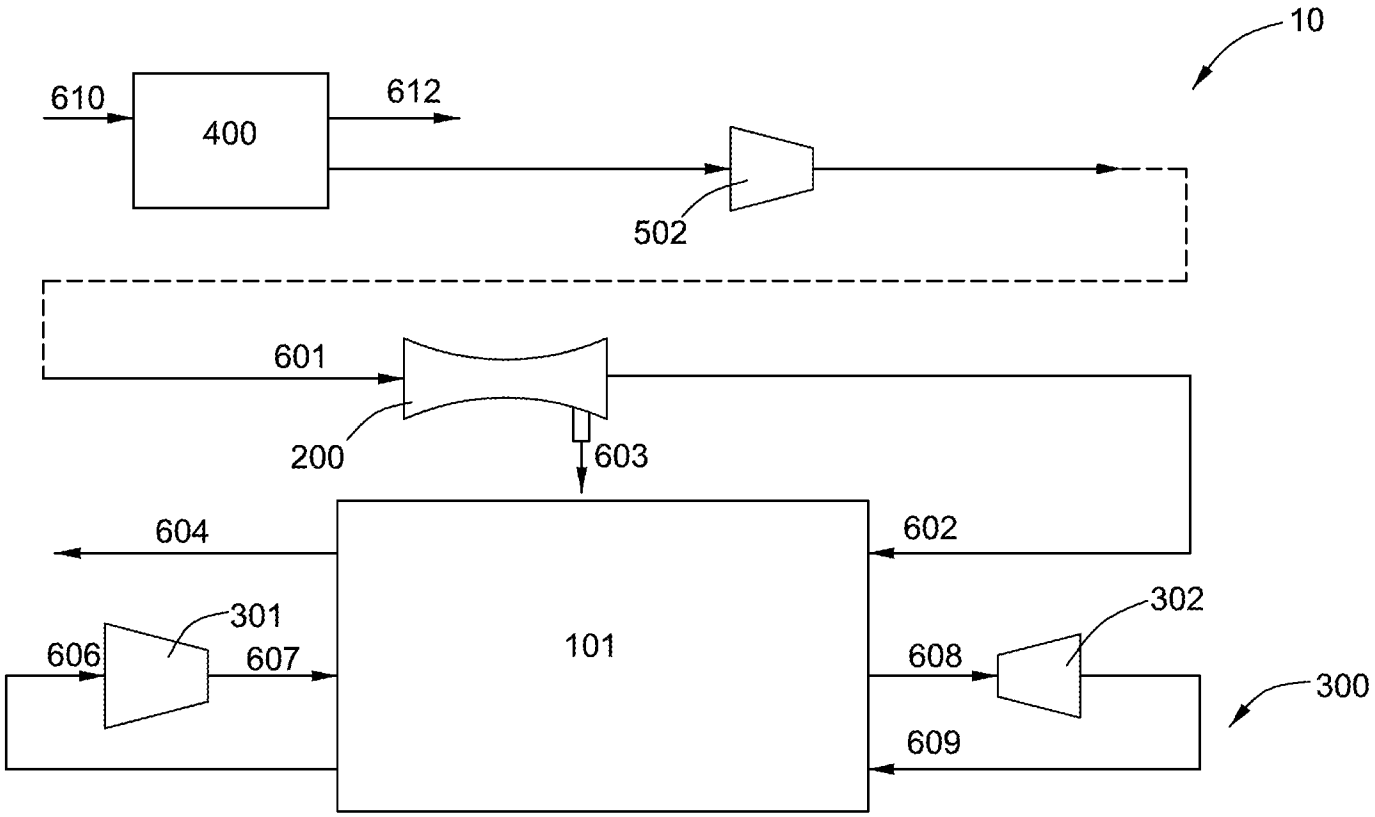
FIG. 5 is a schematic diagram of a system for producing LNG in accordance with a further embodiment.

In some embodiments, the system 10 further comprises a compressor located upstream from the supersonic chiller 200 to provide a higher pressure of the first gaseous natural gas stream 601. For example, in the embodiment according to FIG. 4, a compressor 501 is located upstream from the pretreatment module 400; in embodiment according to FIG. 5, a compressor 502 is located between the pretreatment module 400 and supersonic chiller 200.

Figure 6:
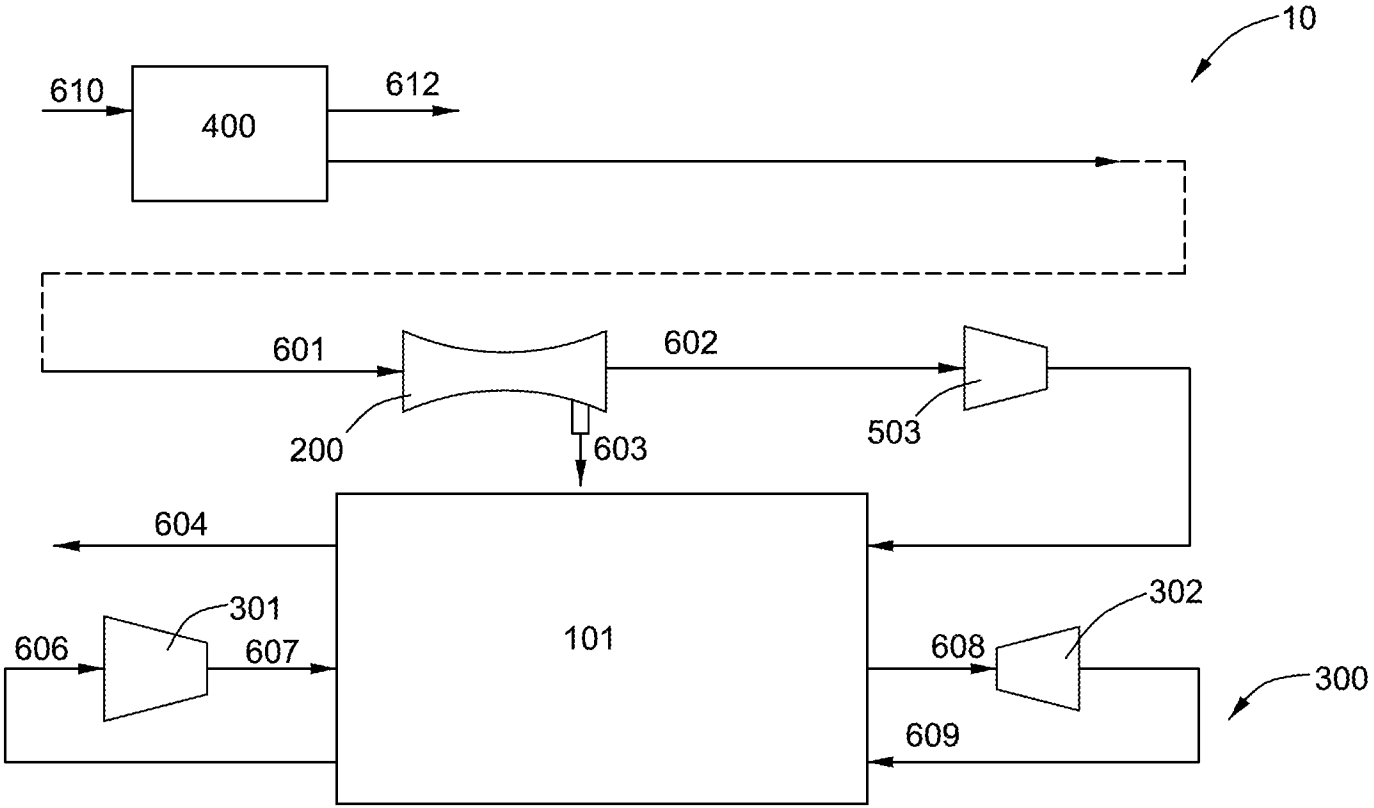
FIG. 6 is a schematic diagram of a system for producing LNG in accordance with a further embodiment.

In the embodiment according to FIG. 6, the system 10 further comprises a compressor 503 located between the supersonic chiller 200 and the cold box 101 to provide a higher pressure of the second gaseous natural gas stream 602.

The above various changes of the system 10 according to FIGS. 2-6 are only for better illustrating and not intended to be limiting.

Figure 8:
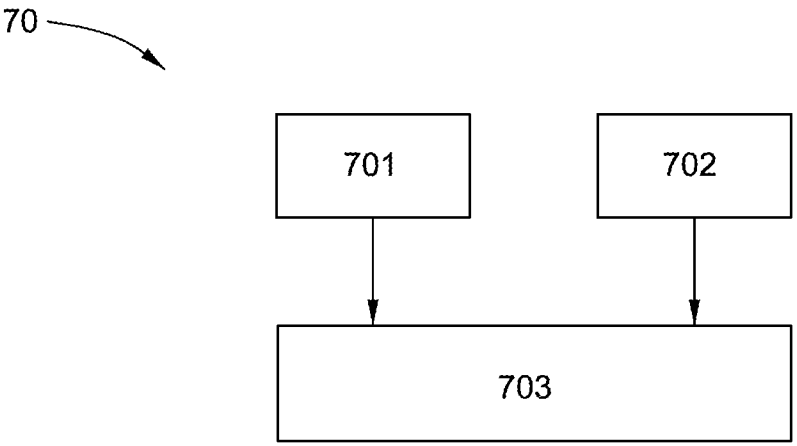
FIG. 8 is a schematic diagram of a method for producing LNG in accordance with an embodiment.

FIG. 8 is a schematic diagram of a method 70 for producing LNG in accordance with an embodiment. The method 70 comprises the following steps 701, 702 and 703.

In step 701, a cold stream of refrigerant is provided via a refrigeration loop system. In step 702, a first gaseous natural gas stream is received and chilled via a supersonic chiller to produce a liquefied natural gas liquid, and the liquefied natural gas liquid is separated from the first gaseous natural gas stream via the supersonic chiller to obtain a second natural gas stream. In step 703, the cold stream of refrigerant and the second natural gas stream are received via a cold box, and the second gaseous natural gas stream is cooled to obtain a liquefied natural gas by heat exchanging via the cold box between the second gaseous natural gas stream and the cold stream of refrigerant.

Various changes of the method 70 may be made. Some embodiments are introduced hereinafter to describe some of the various changes of the method 70.

Figure 9:
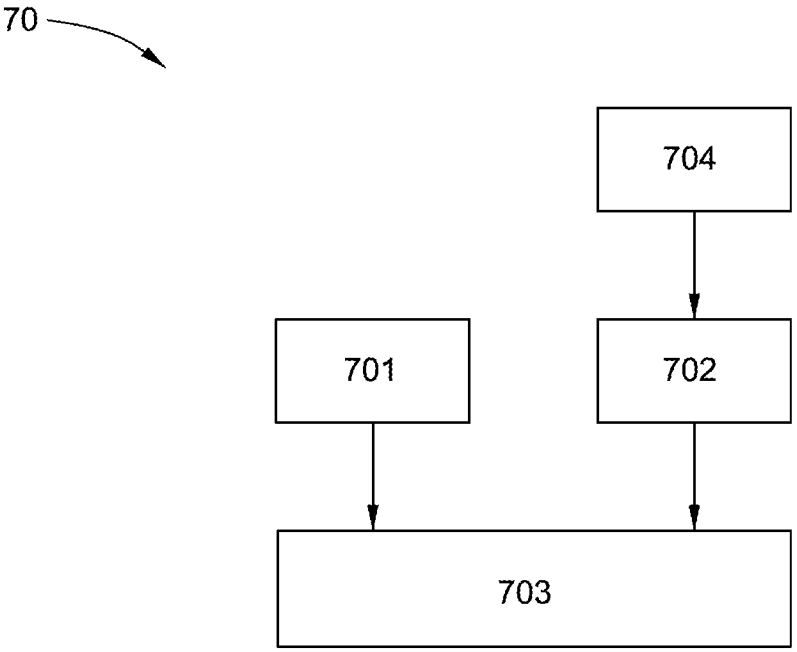
FIG. 9 is a schematic diagram of a method for producing LNG in accordance with another embodiment.

In the embodiment according to FIG. 9, the method 70 further comprises step 704. In step 704, a raw natural gas stream is received via a pretreatment module, and an impurity is separated from the raw natural gas stream to obtain the first gaseous natural gas stream, and the first gaseous natural gas stream is provided to the supersonic chiller.

Figure 10:
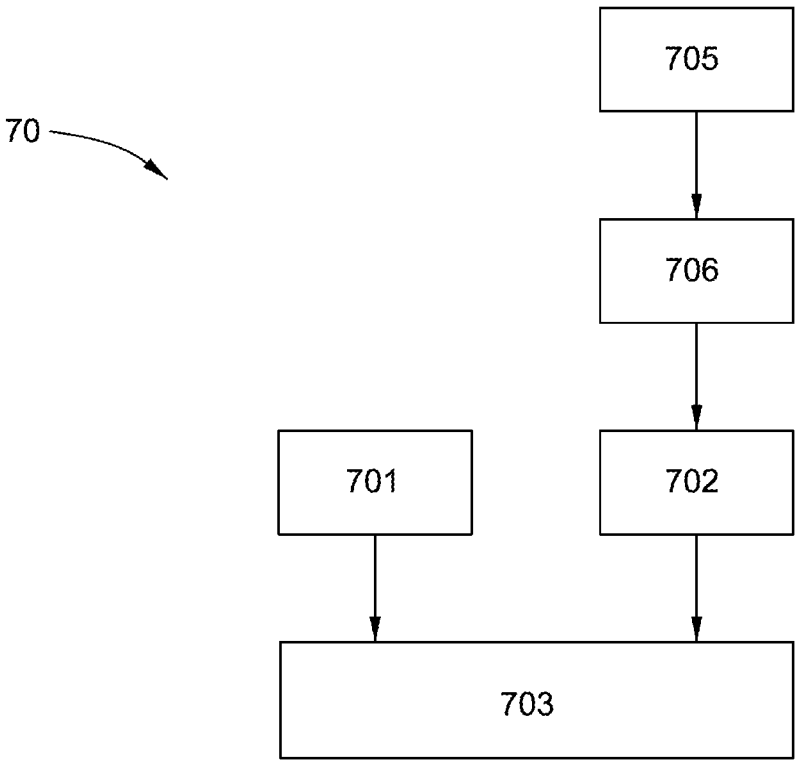
FIG. 10 is a schematic diagram of a method for producing LNG in accordance with a further embodiment.

In the embodiment according to FIG. 10, the method 70 further comprises following steps 705 and 706. In step 705, a raw natural gas stream is received via a pretreatment module, and an impurity is separated from the raw natural gas stream via the pretreatment module to obtain the third gaseous natural gas stream, and the third gaseous natural gas stream is provided to the pre-cooling module. In step 706, the third gaseous natural gas stream is received and cooled via a pre-cooling module to obtain the first gaseous natural gas stream, and the first gaseous natural gas stream is provided to the supersonic chiller.

The order of the steps and the separation of the actions in the steps shown in FIGS. 8-10 are not intended to be limiting. For example, the steps may be performed in a different order and an action associated with one step may be combined with one or more other steps or may be subdivided into a number of steps. One or more additional actions may be included before, between and/or after the method 70 in some embodiments.

In traditional LNG production system and method, because of the existence of a cold box for cooling the natural gas, it is quite easy to think of utilizing the cold box to cool the natural gas for several times to firstly obtain NGL and secondly obtain LNG. However, according to the embodiments of the present application, the cold box is not considered for producing NGL, instead, NGL has been separated from the natural gas before feeding the natural gas to the cold box. Thereby, the size of cold box is reduced and the cost of the LNG production system is saved. In some embodiments, the size of cold box may be reduced by 20%. Besides, compared with the traditional systems and methods, with the same feeding condition, more NGL may be obtained according to the embodiments of the present application.

While embodiments of the invention have been described herein, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

Furthermore, the skilled artisan will recognize the interchangeability of various features from different embodiments. The various features described, as well as other known equivalents for each feature, can be mixed and matched by one of ordinary skill in this art to construct additional systems and techniques in accordance with principles of this disclosure.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A system for producing liquefied natural gas, the system comprising:

a refrigeration loop system for providing a cold stream of refrigerant;

a supersonic chiller for receiving and chilling a first gaseous natural gas stream, accelerating the first gaseous natural gas stream to a supersonic velocity and chilling the first accelerated gaseous natural gas stream to produce a liquefied natural gas liquid, and separating the liquefied natural gas liquid from the first gaseous natural gas stream to obtain a second gaseous natural gas stream;

a cold box for receiving the cold stream of refrigerant and the second gaseous natural gas stream from the supersonic chiller, and cooling the second gaseous natural gas stream to obtain a liquefied natural gas by heat exchanging between the second gaseous natural gas stream and the cold stream of refrigerant, whereon the cold box comprises a pre-cooling module for receiving and cooling a third gaseous natural gas stream to obtain the first gaseous natural gas stream, and providing the first gaseous natural gas stream to the supersonic chiller; and a compressor downstream of the supersonic chiller and upstream of the cold box to increase the pressure of the second natural gas stream entering the cold box.

2. The system of claim 1, wherein the temperature of the first gaseous natural gas stream ranges from 0° C. to −10° C.

3. The system of claim 1, further comprising a compressor located upstream from the supersonic chiller.

4. The system of claim 1, wherein the temperature of the liquefied natural gas liquid ranges from −45° C. to −75° C.

5. The system of claim 1, wherein the pressure of the first gaseous natural gas stream ranges from 3 MPa to 8 MPa.

6. The system of claim 1, wherein the refrigeration loop system comprises:

a compressing module for receiving and compressing a heat exchanged refrigerant stream to obtain a hot stream of refrigerant, and providing the hot stream of refrigerant to the cold box, wherein the cold box cools the hot stream of refrigerant to obtain a cooled refrigerant stream; and an expanding module for receiving and expanding the cooled refrigerant stream to obtain the cold stream of refrigerant, and providing the cold stream of refrigerant to the cold box, wherein the cold box obtains the heat exchanged refrigerant stream by heat exchanging the cold stream of refrigerant with the second gaseous natural gas stream and the hot stream of refrigerant.

7. The system of claim 1, wherein the refrigerant comprises nitrogen, methane, a mixed refrigerant or any combination thereof.

8. A method for producing liquefied natural gas, the method comprising:

providing, via a refrigeration loop system, a cold stream of refrigerant;

receiving and chilling, via a supersonic chiller, a first gaseous natural gas stream to produce a liquefied natural gas liquid, and separating the liquefied natural gas liquid from the first gaseous natural gas stream to obtain a second natural gas stream;

compressing the second natural gas stream exiting the supersonic chiller to increase the pressure of the second natural gas stream prior to entering a cold box;

receiving, via the cold box, the cold stream of refrigerant and the compressed second natural gas stream, and cooling the second gaseous natural gas stream to obtain a liquefied natural gas by heat exchanging between the second gaseous natural gas stream and the cold stream of refrigerant; and receiving and cooling, via a pre-cooling module, a third gaseous natural gas stream to obtain the first gaseous natural gas stream, and providing the first gaseous natural gas stream to the supersonic chiller, the cold box comprising the pre-cooling module.

9. The method of claim 8, further comprising: receiving a raw natural gas stream and separating an impurity from the raw natural gas stream to obtain the first gaseous natural gas stream, and providing the first gaseous natural gas stream to the supersonic chiller.

10. The method of claim 8, further comprising: receiving a raw natural gas stream and separating an impurity from the raw natural gas stream to obtain the third gaseous natural gas stream, and providing the third gaseous natural gas stream to the pre-cooling module.

11. The system of claim 1, further comprising a second compressor upstream of the supersonic chiller and configured to increase the pressure of the first gaseous natural gas stream before entering the supersonic chiller.

12. The system of claim 1, further comprising an absorbent upstream of the supersonic chiller to remove acid gases from the first gaseous natural gas stream.

13. The method of claim 9, further comprising removing acid gases from the raw natural gas stream to obtain the first gaseous natural gas stream before the first gaseous natural gas stream is received and chilled by the supersonic chiller.

14. The method of claim 13, wherein the step of removing acid gases from the raw natural gas stream comprises contacting the raw natural gas stream with an absorbent.

* * * * *